United States Patent [19]

Knippels et al.

[11] Patent Number: 4,901,981

[45] Date of Patent: Feb. 20, 1990

[54] DEVICE FOR REMOVING A STAPLE FROM A STAPLED BUNDLE OF SHEETS

[75] Inventors: Antonius A. Knippels, Venlo; Thomas T. C. van Gerwen, Veldhoven, both of Netherlands

[73] Assignee: Oce-Nederland B.V., Venlo, Netherlands

[21] Appl. No.: 144,459

[22] Filed: Jan. 15, 1988

[30] Foreign Application Priority Data

Jan. 16, 1987 [NL] Netherlands ..... 8700094

[51] Int. Cl.[4] ..... B25C 11/00

[52] U.S. Cl. ..... 254/28

[58] Field of Search ..... 254/22, 28; 227/63, 227/156

[56] References Cited

U.S. PATENT DOCUMENTS

| | | | |
|---|---|---|---|
| 2,499,432 | 3/1950 | Von Cseh | 254/28 |
| 2,741,457 | 4/1956 | Furumizo | 254/28 |
| 3,528,643 | 9/1970 | Munson et al. | 254/28 |
| 3,625,482 | 12/1971 | Viel, III | 254/28 |
| 4,513,951 | 4/1985 | Rogers | 254/28 |

*Primary Examiner*—Judy J. Hartman

*Attorney, Agent, or Firm*—Reed, Smith, Shaw & McClay

[57] ABSTRACT

Device for removing a staple from a stapled bundle of sheets by moving the bundle over a supporting element past a staple removing strip. The strip extends above the supporting element at a small acute angle therewith and is fixed to an arm which is rotatably mounted on a shaft positioned at the side of the strip facing away from the acute angle and below the supporting element. The strip is moved upwards when a stapled bundle of sheets, with the legs of the staple facing downwards, is fed between the supporting element and a wedge-like tapered end of the strip, which end presses onto the supporting element. When in this way the staple is positioned in front of the wedge-like tapered end of the strip, the bundle is pulled towards the strip, the end of the strip penetrates between the crown of the staple and the bundle and the staple thereafter is pulled out of the bundle. The pulled-out staple drops in a receiving tray formed beneath the supporting element.

8 Claims, 2 Drawing Sheets

DEVICE FOR REMOVING A STAPLE FROM A STAPLED BUNDLE OF SHEETS

FIELD OF THE INVENTION

This invention relates to a device for removing a staple from a stapled bundle of sheets, which device comprises a strip provided with an end projecting freely and tapering at least partly like a wedge, which end can be inserted between the bundle and the staple present therein.

BACKGROUND OF THE INVENTION

Staples have been used to secure bundles of papers together for many years. Almost commensurate with the development of the staple and means for securing same to a bundle, arose the need to remove the secured staple, and initially this need was met through the expedient of fingernails, scissors, etc., none of which proved wholly satisfactory for the task.

Eventually machines were developed expressly for the purpose of removing staples. Initially hand-operated machines were developed, such as those found in U.S. Pat. No. 4,513,951; U.S. Pat No. 2,102,087; Swiss Patent No. 278,608; West German Patent Application No. 1,195,269; and French Patent No. 1,017,105. See also European Patent Application No. 0,022,364. The development of hand-operated machines was followed by automatically operated machines. The automatic machines are typically provided with a gripping means, in which a stapled bundle can be positioned, such that the gripping means can pull the staple out of the positioned bundle. The drawback of such automatic machines, however, is that such machines only operate smoothly when removing staples from bundles stapled at a fixed location relative to the bundle. While such machines may be used with some success in situations where the bundle is stapled automatically at a predetermined location, the same machine will not work well in the case of hand-stapled bundles, in which the staple location is apt to vary widely from one bundle to the next. In order to utilize the automatic staple removing machines for bundles which have been stapled by hand, such machines must be equipped both with a detection system for detecting the location of the staple in the bundle, and with a positioning system for putting the gripping means in the proper position relative to the staple. Such modification results in a complicated and consequently costly device.

There exists a need for a simple device for removing staples from bundles of stapled sheets, for example for removing staples from a stapled bundle of originals, in order to process these originals automatically on a copying machine fitted with an automatic feeding device for the originals.

One such simple device is that shown in European Patent Application No. 0,106,381, which describes a copying machine, the top of which has a cavity in which a strip having a wedge-shaped end is provided, with the top of the strip being situated largely in the same plane as the top of the copying machine. To remove a staple from a stapled bundle using this device, the operator must position the bundle such that the bent legs of the staple face upwards, and must position the staple immediately in front of the wedge-shaped end of the strip. The operator then pulls the bundle towards the strip to remove the staple. Frequently when the bundle is pulled towards the strip, the wedge-shaped end of the strip does not penetrate between the staple and the lowermost sheet, rather rushes past the bundle. Efforts to avoid this result by manually exerting a force on the bundle creates the risk that the bundle may be pressed askew on the wedge-shaped end, which may in turn penetrate the individual sheets of the bundle, damaging the sheets. Damaged sheets in turn can cause malfunctions in the copying operation. Another disadvantage of exerting manual pressure on the bundle is that this allows only one hand (that hand not exerting the pressure) for effecting the pulling movement. As a result, it is difficult to pull the bundle controllably in a straight direction over the strip. Pressing manually on the staple during the pulling sequence has the added disadvantage of creating a risk that the rising ends of the staple may penetrate into the hand and cause injuries.

The object of the present invention is to provide a simple device for removing a staple from a stapled bundle of sheets, which device does not exhibit the drawbacks mentioned above.

SUMMARY OF THE INVENTION

The present invention solves the problems of prior devices such as those referred to above by employing a strip with an end projecting freely and tapering at least partly to form a wedge-like end, which end is inserted freely between the bundle and the staple present therein. The device is provided with a supporting element having a contact surface on which the wedge-like end of the strip is pressed at an acute angle of at most 20°. A fastening means movably connects the strip to the supporting element in order to allow the operator to insert the bundle on the side of the acute angle, between the supporting element and the strip prior to pulling the bundle back to remove the staple, in such a way that manual pressure need not be applied to guide the bundle.

The present invention thus permits a staple to be removed from a stapled bundle of sheets simply and reliably, and permits the bundle to be held by both hands at all times.

In a preferred embodiment of the invention the supporting element is arranged in a fixed position, and the contact surface is situated beneath the wedge-like tapered end of the strip. In this embodiment, the strip presses on the supporting element by spring force and/or by gravity. In this way the bundle can be easily inserted between the supporting element and the strip, and the position of the staple relative to the wedge-like tapered end of the strip always remains visible from above.

In a most preferred embodiment of the device the fastening means comprises an arm and a shaft, which arm has one end rigidly attached to the strip, is bent alongside the strip, and extends as far as that side of the strip that faces away from the acute angle and to below the level of the contact surface, where the other end of the fastening means is rotatably mounted on the shaft. The shaft intersects the strip at a right angle and is fitted at a fixed location with respect to the supporting element. This embodiment offers the advantage that the angle between the strip and supporting element decreases with the decreased thickness of the bundle of sheets placed between the strip and supporting element. Thus, thin bundles, which are most sensitive to damage due to strip penetration, are less apt to be damaged, because in these cases the strip is practically parallel to the paper surface.

Other features and advantages of the invention will become apparent from the following description of an embodiment of a device according to the invention, with reference to the accompanying drawings in which.

DETAILED DESCRIPTION OF THE INVENTION

Figure 1:
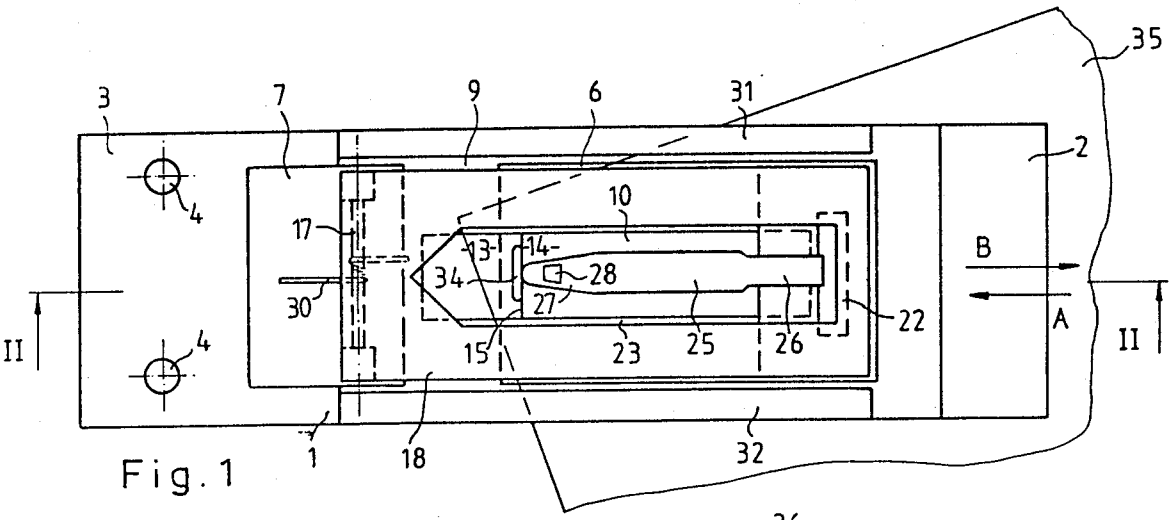
FIG. 1 is a top view of a device according to the invention.
Figure 2:
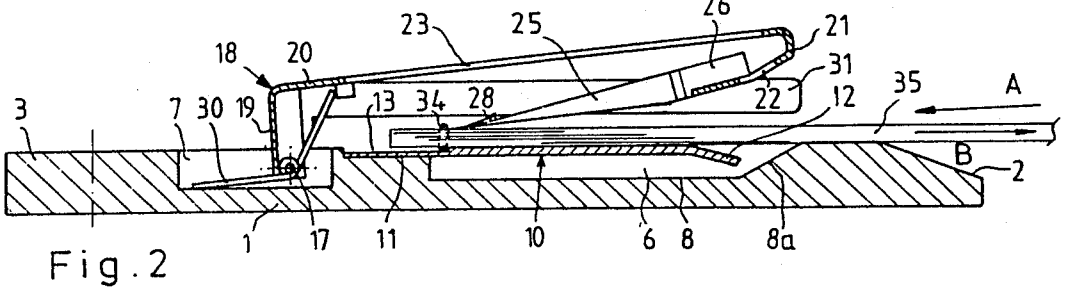
FIG. 2 is a sectional view taken along line II—II in FIG. 1.

The device represented in FIGS. 1 and 2 comprises a supporting means such as an oblong block 1, the top of which preferably has a bevelled front side 2, and a rear side 3. Near the rear side 3, holes 4 have been provided in the block 1 for fitting the block 1 detachably on a stand (not shown), e.g., a copying machine.

The top of the block 1 has a first and second oblong cavity 6 and 7, respectively, provided one behind the other, and separated by a ridge 9. The first oblong cavity 6 has a flat base 8, which extends from a front wall 8*a* near the front side 2 of the block 1 past the middle of the block 1 and constitutes a receiving tray for pulled staples. The front wall 8*a* of the cavity 6 and the flat base 8 form an angle of about 120°. The remaining walls of the cavity 6 (not numbered) are inclined at right angles to the base 8 and to one another. A supporting element 10 in the form of a plate is secured by one end 11 onto the ridge 9 between the two cavities 6 and 7. The supporting element 10 extends from its end 11 over the middle of the cavity 6 as far as just in front of the wall 8*a*.

The supporting element 10 has a freely projecting end 12 which is bent slightly downwards and assists in guiding a bundle into operative engagement with the device. The top side of the supporting element 10 has a smooth surface which is largely situated in the same plane as the top side of the block 1. The end 11 of the supporting element 10 is provided with a recess 13, as a result of which the top surface of this end has a level approximately 0.5 mm lower than the top surface 14 of the rest of the supporting element 10. This difference in level corresponds with the thickness of the wire generally used for staples. The transition between the lower-levelled top surface of the recess 13 and the higher-levelled top surface 14 is formed by a surface 15 which is perpendicular to the top surface 14 of the supporting element 10.

The device includes a fastening means for fastening the strip 25 to the block 1, which consists of a shaft 17 and an arm 18. The shaft 17 is fitted in a fixed location with respect to the block 1 and intersects the arm 18 at a right angle, extending through the second cavity 7 in a direction transverse to the longitudinal direction of the supporting element 10. The arm 18 consists of an elongated L-shaped part, having a short leg 19 and a long leg 20, and a U-shaped part 21, adjoining the long leg 20. The end of the short leg 19 is rotatably mounted about the shaft 17. The long leg 20 of the arm 18 extends above the cavity 6 and is provided with a window 23 situated above the supporting element 10. The window may be made of any transparent, durable material. In the portion of the U-shaped part 21 which faces downwards a hole 22 is formed which is situated above the cavity 6. A strip 25 is secured with one end 26 of the strip 25 attached to the downward facing portion of the U-shaped part 21. The long leg 20 of the arm 18 extends from the U-shaped part 21 over the strip 25 and the short leg 19 extends below the level of the contact surface 14. The strip 25 is visible through the window 23 in the long leg 20. The strip is preferably made of a durable material such as a hardened steel which will not deform appreciably over many uses.

As best seen in FIG. 2, the lower sides of the strip 25 and the U-shaped part 21 have smooth surfaces which adjoin one another. The strip 25 has a freely projecting wedge-like tapered end 27. As used herein, the term "wedge-like" tapering is understood to mean that the top side and lower side of the strip 25 taper to each other like a wedge as shown in FIG. 2. This wedge-like tapering may be accomplished, for example, by a solid piece of material as shown in FIG. 2, or may be formed by a thin strip of metal bent on itself such that the bend comprises the tapered end 27. It is not necessary for the freely projecting end of the strip 25 to taper wedge-like as far as the end 27 of the strip 25. A strip 25, the thickness of which gradually decreases to within a short distance (e.g., 10 mm) from the end 27 of the strip 25 and then remains constant, as represented in FIG. 2, may also be used. As shown in FIG. 1, the side edges of the strip 25 also taper towards the tapered end 27 to enable the strip 25 to more readily engage a staple 24. As shown in FIG. 1, starting from the tapered end 27, the width of the strip 25 gradually increases over a relatively long part, becomes constant, and decreases again at the other end 26 of the strip 25.

The thickness of the strip 25 as seen in FIG. 2 gradually increases from about 0.5 mm at the wedge-shaped end 27. If no bundle of sheets is present, the wedge-like tapered end 27 will be in contact with the top surface 14 of the supporting element 10 at a location which is near the edge formed by the surface 15. In the top surface of the strip 25, near the wedge-shaped end 27, a cavity is formed, in which a lip 28 is disposed, which lip 28 can be kept by spring force in a position such that the lip 28 projects above strip 25. This lip 28 can be pressed against the action of the spring to a position such that the lip 28 no longer projects above the strip 25.

Fitting around the shaft 17 of the fastening means is a biasing means which preferably comprises a pre-compressed helical spring 30 provided with projecting ends, with one end pressing on the bottom of the cavity 7, and the other end being secured to the arm 18 as shown in FIG. 2. Two L-shaped arms 31 and 32 are preferably formed on the block 1 for the purpose of guiding a bundle into the device, the long legs of which extend on both sides of the leg 20 of the arm 19 and at some distance above the block 1. The distance between the long legs of these arms 31 and 32 and the top side of the block 1 defines the maximum thickness of the bundle that can be processed in the device.

As shown in FIG. 2, the wedge-like tapered end 27 of the strip 25 presses on the bundle, but will press on the contact surface 14 of the supporting element 10 when no bundle is present. The strip 25 is angled such that when pressed against the contact surface 14, the side of the wedge-like tapered end 27 of the strip 25 which contacts the contact surface 14 makes an acute angle of at most 20° relative to the contact surface 14. The strip 25 presses against the contact surface 14 by gravity or may be biased against the contact surface 14 by the spring 30.

To remove a staple 34 from a stapled bundle of sheets 35, the bundle, with the bent-over legs of the staple 34 facing downwards, is slid into the front side of the device over the block 1 into the opening formed between the block 1 and the U-shaped part 21 of the arm 18, and over the supporting element 10, as indicated in the Figures by arrow A. When the bundle is pushed through the device in this manner, the arm 18 will be forced up against the action of the spring 30, and the arm 18 thus rotates about the shaft 17. The bundle 35 is then positioned by hand in such a way that the staple 34, being visible through the window 23, is located in front of the wedge-like tapered end 27 of the strip 25 as shown in the Figures. The wedge-shaped end 27, too, is visible through the window 23. In this position, the bent-over legs of the staple 34 are located in the recess of the supporting element 10 formed by the surfaces 13 and 15 and the crown of the staple 34 lies in front of the end 27 of the strip 25.

Once the bundle 35 and staple 34 are thus positioned, the operator pulls the bundle 35 in the direction indicated in the Figures by arrow B, which is opposite to the direction of feeding the bundle. In this operation the legs of the staple 34 will initially catch behind the raised edge 15, while the wedge-shaped end 27 of the strip 25 penetrates between the crown of the staple and the uppermost sheet of the bundle. It may occur, however, that the end 27 of the strip 25, instead of penetrating between the staple and bundle, strikes the crown of the staple. The legs of the staple abut the raised edge 15 at that moment, preventing the staple from being tilted by the pulling force, which could cause the crown of the staple to be pulled more tightly against the bundle, making it more difficult to bring the end 27 of the strip 25 between the staple and the bundle. In removing staples from thin bundles, in the absence of the raised edge 15 such a tilting could easily occur, because thin bundles offer little resistance to such tilting. Moreover, since thin bundles tend to tear more readily, they would tend to be pulled to pieces easily in the absence of the edge 15. As shown in FIG. 1, the tip of the wedge-like end 27 is substantially aligned with the raised edge 15 so that the combined forces of the end 27 and edge 15 on the crown and legs, respectively, of the staple can be maximized. In this way, the raised edge 15 causes the staple 34 to resist tilting at the same time the end 27 engages the crown of the staple.

When the crown of the staple 34 is pulled over the strip 25, upon continuing the pulling operation, the staple can be drawn easily over the raised edge 15, because of the slight height of the raised edge 15. On continuing the movement of the bundle in the direction of pulling (arrow B), the strip 25 pulls the staple 34 out of the bundle 35, the staple legs being bent straight. In so doing, the staple 34 slides over the wedge-shaped end 27, and continues along the strip 25 until the staple encounters the lip 28 and causes the lip to be depressed. As the staple passes the lip 28, the wedge-shaped end 27 forces the staple legs to bend straight, thereby removing the staple from the bundle, at which point the bundle can be removed freely from the device. At this point, the staple 34 has passed the lip 28. The staple 34 hangs on the strip 25 and the lip 28, which has sprung upwards again, prevents the staple from sliding back towards the wedge-shaped end 27. On removal of subsequent staples the removed staples press against the first-removed staple, with the result that the first-removed staple finally reaches the end 26 of the strip and, through the opening 22, drops into the receiving tray formed by the cavity 6. The receiving tray can easily be emptied by detaching the device from the stand and inverting it. In so doing, arm 18 together with strip 25 will swing downwards, so that the collected staples can drop freely out of the receiving tray.

Figure 3:
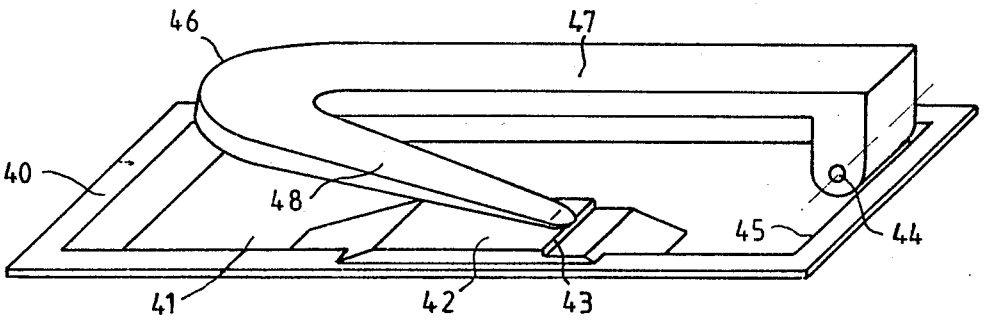
FIG. 3 is a perspective view of a preferred embodiment of the present invention.

Another preferred embodiment of the invention, represented in FIG. 3, comprises an oblong block 40 having at the top thereof an oblong cavity 41. A supporting element 42 is secured to the block 40 in the cavity near the middle of a long side of the cavity. The top side of the supporting element 42 has the same characteristics as the top side of the supporting element 10 shown in FIGS. 1 and 2 and accordingly also has a transition edge 43 which is similar to the edge 15 shown in FIG. 1.

A shaft 44 is fitted at a fixed location with respect to the block 40, extending through the cavity near a short rear wall 45 thereof in a direction transverse to the longitudinal direction of the cavity 41. The shaft 44 intersects the strip 48 at a right angle and is fitted at a fixed location with respect to the block 40. A U-shaped arm 46 having elongated legs 47 and 48 is rotatably mounted to the shaft 44 at the free end of the leg 47. The leg 47 extends from the mounted end over the cavity at the long side of the cavity 41 opposite to the long side at which the supporting element 42 is secured, thereby not covering the top side of the supporting element 42. The other leg 48 of the U-shaped arm 46 adjoins the leg 47 near the short front wall of the cavity which is opposite to the short rear wall 45.

The leg 48 forms the staple removing strip, and the arm 46 and shaft 44 form the fastening means for the strip 48. The leg 47, as seen in FIG. 3, extends beside the strip 48 and is located at an elevated level with respect to the strip 48. The strip 48 is rigidly attached to, and extends from, the bent portion of the arm 46 longitudinally over the cavity 41 towards the supporting element 42, thereby forming a small acute angle with the top side of the supporting element 42. The wedge-like tapered end of the strip 48 will be in contact with the top side of the supporting element 42 and the extreme end of the strip 48 projects approximately 1 mm beyond the transition edge 43 of the supporting element 42. The thickness of the strip 48 gradually decreases, preferably from 6 mm at a distance 37 mm from the free end of the strip 48 to 1 mm at a distance of 7 mm from the end, remains nearly constant up to 3 mm from the free end and then further decreases to 0.4 mm at the extreme end. The width of the strip 48 gradually decreases from 11 mm at a distance of 37 mm from the free end, to 9 mm at a distance of 7 mm from the free end. The free end is rounded with a radius of 4 mm. The device shown in FIG. 3 is compact and operates in substantially the same way as the device shown in FIGS. 1 and 2, except that the staples captured by the strip 48 are periodically removed from the strip by moving said staples towards the free end.

I claim:

1. A device for removing a staple from a stapled bundle of sheets, compromising a strip projecting freely to a wedge-like tapered end, said end capable of being inserted between the bundle and the staple present therein, said device including a supporting means having a contact surface on which surface the wedge-like tapered end of the strip is pressed at an acute angle of at most 20° relative to the contact surface, said device further including a fastening means for connecting the strip movably to the supporting means such that the bundle may be inserted between the supporting means and the strip and pulled backwards relative to the direction of insertion of said bundle to remove the staple by means of the strip, wherein the fastening means comprises an arm and a shaft, said arm having one U-shaped end rigidly attached to the strip, the arm being bent over the strip and extending beyond the edge of the strip that faces away from the acute angle, the other end of the arm being bent with a portion thereof extending below the level of the contact surface and being rotatably mounted on the shaft, the shaft being perpendicular to the strip and fitted at a fixed location with respect to the supporting means.

2. A device according to claim 1 wherein the supporting means includes a supporting element which is arranged in a fixed position with the contact surface under the wedge-like tapered end of the strip, and said strip presses on the supporting element by a biasing force.

3. A device according to claim 1, wherein the elongated portion of the arm which extends over the strip is provided with a window through which the wedge-like tapered end of the strip is visible.

4. A device according to claim 2, or 3 wherein a top surface of the strip is provided with a lip near the wedge-like tapered end such that the lip can project above the strip.

5. A device according to claim 1, 2 or 3 wherein the supporting means is provided with a shallow recess which is situated near the place where the wedge-like tapered end of the strip comes in contact with the contact surface of the supporting means.

6. A device according to claim 2 wherein the fastening means comprises an arm and a shaft, said arm having one end rigidly attached to the strip, said arm having an elongated portion which extends beside one end of the strip and at a level lying above the strip, said arm having another end rotatably mounted on the shaft, the shaft being perpendicular to the strip and fitted at a fixed location with respect to the supporting means.

7. A device according to claim 4 wherein the supporting means is provided with a shallow recess which is situated near the place where the wedge-like tapered end of the strip comes in contact with the contact surface of the supporting means.

8. A device as described in claim 2 wherein the biasing force is gravity.

* * * * *